US006684039B1

(12) United States Patent
Wazana et al.

(10) Patent No.: US 6,684,039 B1
(45) Date of Patent: Jan. 27, 2004

(54) REASSEMBLED PROCESS CARTRIDGE AND METHOD OF MANUFACTURE

(75) Inventors: Yoel Wazana, Northridge, CA (US); Joda Paulus, Palmdale, CA (US)

(73) Assignee: Wazana Brothers International, Inc., Chatsworth, CA (US)

( * ) Notice: Subject to any disclaimer, the term of this patent is extended or adjusted under 35 U.S.C. 154(b) by 0 days.

(21) Appl. No.: 10/278,730

(22) Filed: Oct. 22, 2002

(51) Int. Cl.[7] ..... G03G 21/18
(52) U.S. Cl. ..... 399/109; 156/73.5
(58) Field of Search ..... 399/109, 106, 399/111; 156/73.1, 73.5

(56) References Cited

U.S. PATENT DOCUMENTS 5,781,831 A * 7/1998 Matsuzaki et al. ..... 399/111

FOREIGN PATENT DOCUMENTS

JP 11-149208 A * 6/1999
JP 2002-108175 A * 4/2002

* cited by examiner

*Primary Examiner*—Joan Pendegrass
(74) *Attorney, Agent, or Firm*—Jon Hokanson, Esq.; Coudert Brothers LLP

(57) ABSTRACT

A remanufactured and reassembled laser printing device process or toner cartridge and method of manufacture in which a recharged and reassembled process cartridge is ultrasonically resealed, without the use of replacement energy director elements, by ultrasonic welding at the location of the original manufacturing ultrasonic weld using residual material from the original energy director elements.

It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims.

5 Claims, 7 Drawing Sheets

REASSEMBLED PROCESS CARTRIDGE AND METHOD OF MANUFACTURE

TECHNICAL FIELD

The present invention relates to the field of laser printing device process (toner) cartridge remanufacture in which a reassembled toner cartridge is resealed by ultrasonic welding.

BACKGROUND ART

Process or toner cartridges for laser printing are engineered and manufactured to a high degree of precision necessary for proper operation and good printed image quality. Central to proper operation of a process (toner) cartridge is proper alignment and orientation of its various components, as well as proper sealing of the cartridge to avoid the leakage of toner. Original equipment manufacturers achieve the rigidity necessary to maintain the alignment and orientation of components, in substantial part, by ultrasonically welding the sections of the toner or process cartridge together. The process of remanufacturing a toner or process cartridge requires that the cartridge be disassembled and that a hopper section of the cartridge which holds the toner be separated from a roller section which contains the developer roller and other components. When the hopper and roller sections are separated, however, alignment and orientation of components B including particularly that between the developer roller and sealing blade—as well as between other rollers and blades may be lost.

Heretofore, a problem has existed in aligning the various components including, including the sealing blade and/or the developing blade with the developer roller with the necessary precision during reassembly of the sections of the process or toner cartridge. A conventional approach to this problem has been to manually align and fit the sections of the cartridge together, with or without the aid of a positioning jig, then manually to secure the sections together with a number of clips or with adhesive or glue. These techniques, while generally effective suffer a number of drawbacks.

One such drawback is that both clips and adhesive are consumables which increase production costs and cost of the final product. Another drawback is that manual reassembly is quite labor intensive and is subject to human error and variation in quality. In the case of reassembly with adhesive or glue, there typically is a period of a few to several minutes for bonding to take place during which alignment must be maintained, which increases production time and cost. Further, resealing with adhesive often fuses or bonds the sections together, rendering subsequent separation for additional remanufacturing cycles more difficult.

An additional drawback in the use of clips to reassemble the process or toner cartridge is that the rigidity imparted by the original ultrasonic weld is difficult to achieve, and over the life of the cartridge the clips may loosen or become disengaged entirely. In such event, as a result of loss of proper positioning the various components of the cartridge may no longer function as intended. For example, improper positioning of the sealing blade and/or developing blade with the developer roller, may permit excessive toner to accumulate on the developer roller with the result that a mass of excess toner will be transferred to the photoconductive printing drum and thence to the printer paper thereby degrading the printed image quality. Further, disengagement or loosening of a clip may permit toner to leak from the cartridge. In many laser printing devices (such as printers, facsimile machines or copiers), the path of the paper through the printing device passes nearby to the process (toner) cartridge where the clips have been installed. Hence, papers jams may occur if a loose clip projects into the paper path.

Plastic process or toner cartridges manufactured from new components by original equipment manufactures typically are sealed by ultrasonic welding, a technique that until now has been unavailable for use in the remanufacture or reassembly of process or toner cartridges. An impediment to the use of ultrasonic welding in rejoining the sections of a process (toner) cartridge during remanufacture and reassembly is that the ultrasonic energy director element is largely consumed or obliterated by the ultrasonic welding process in the course of original manufacture of the cartridge. Typically, an ultrasonic energy director element is a relatively small feature—usually in the form of a ridge or bump—which extends slightly above the surface of the surrounding area and which contacts a juxtaposed surface to be joined. The energy director is of the same material as the plastic component and is formed in the mold in which the plastic component was originally created. During the ultrasonic welding process it is the energy director element which first melts as a result of frictional heating created by the ultrasonic frequency vibrations between the two surfaces to be welded. It is the melting together of the surfaces, at the location of the energy director element, which upon cooling and solidification, welds the two surfaces together. Thus, the energy director element is melted and largely consumed or obliterated in welding together the sections of the cartridge in the original manufacture of a new process or toner cartridge. Hence, upon separation of the cartridge sections by cutting along the original ultrasonic weld during the remanufacturing process, there no longer exists a complete energy director element from which to initiate ultrasonic welding of these components.

SUMMARY DISCLOSURE OF EMBODIMENTS OF THE INVENTION

The present invention provides a remanufactured process or toner cartridge and method of manufacture in which the sections of the cartridge are ultrasonically welded together without replacing the energy director elements, and without use of consumable components.

In its several embodiments, the present invention provides an operational laser printer device process (toner) cartridge which has been remanufactured and reassembled from components including those from previously depleted toner cartridges, and further provides a method whereby this may be accomplished.

BRIEF DESCRIPTION OF THE DRAWINGS

The nature and scope of the several embodiments of the invention will become apparent from the following detailed description taken in connection with the accompanying drawings, in which.

DESCRIPTION OF THE INVENTION

To illustrate and further describe the embodiments of the present invention, reference will be made to FIGS. 1–8.

Figure 1:
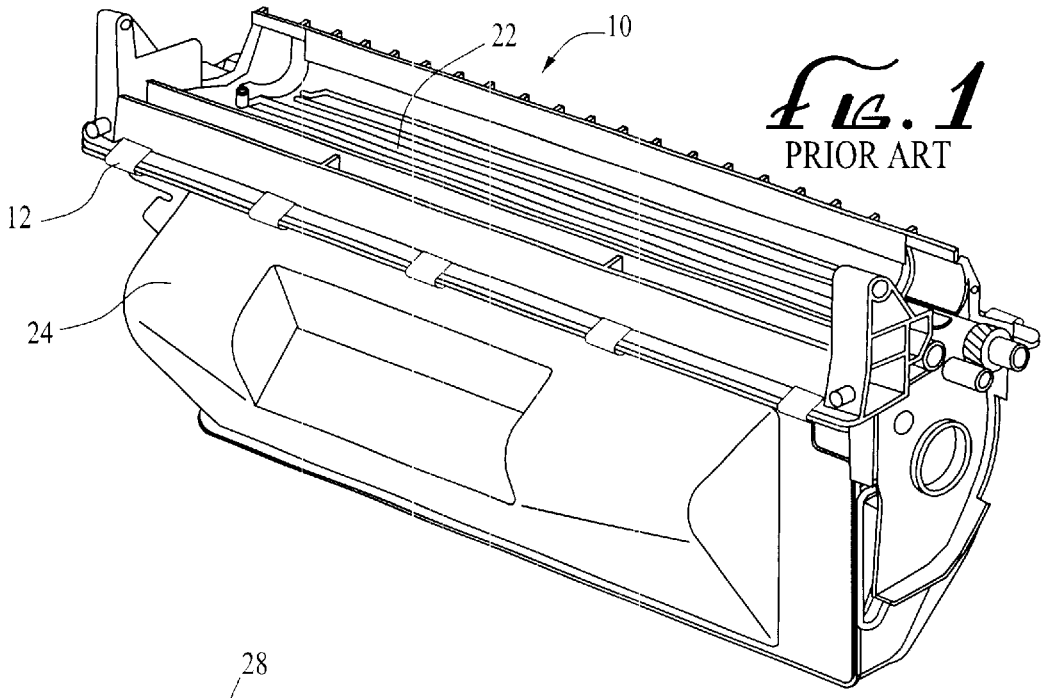
FIG. 1 PRIOR ART
FIG. 1 is a perspective view of a prior art process (toner) cartridge in which the hopper section and the roller section are fastened together by clips.
Figure 2:
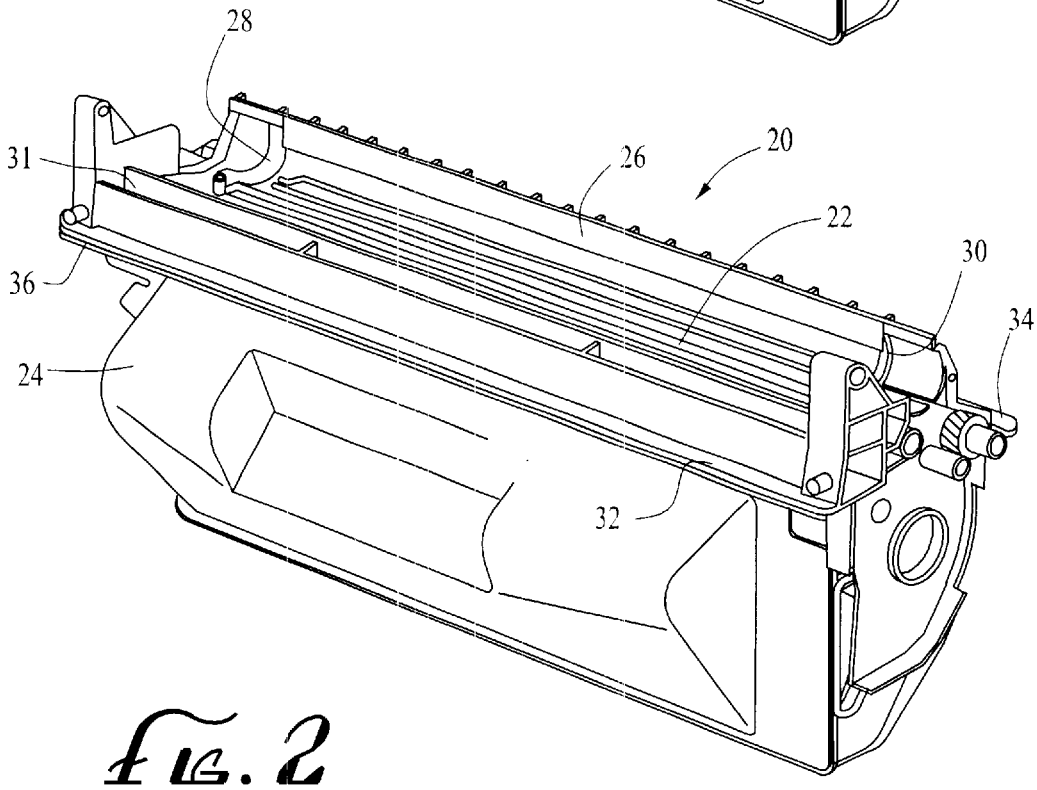
FIG. 2 is a perspective view of a process (toner) cartridge of an embodiment of the present invention in which the hopper section and the roller section are fastened together by ultrasonic welding.

FIG. 1 is a perspective view of a prior art plastic process or toner cartridge (10) in which the hopper section (24) and the roller section (22) are fastened together by clips (12). With reference to FIG. 2 a representative remanufactured process or toner cartridge of an embodiment of the present invention (20) includes longitudinal channel (31) having channel floor (29)(not shown), first peripheral lip (32) and second peripheral lip (34) of plastic roller section (22), and first peripheral lip (36) and second peripheral lip (38)(not shown) of plastic hopper section (24). Sealing blade (26) is disposed adjacent the developer roller (80) which is rotatably attached to roller supports (28) and (30) in roller section (22). Sealing blade (26) is conventionally fabricated of mylar sheet or similar material having a thickness generally of the order of about 0.004". It is required for proper operation of the process or toner cartridge that the sealing blade (26) be essentially straight and uniformly positioned with respect to the surface of the developer roller (80) along its length. Variations in the degree of straightness or uniformity of positioning of sealing blade (26) with respect to the surface of the developer roller (80) may lead to accumulation of excess toner on the developer roller (80) with the printed image degrading results described above. Slight conformational changes of the deformable plastic roller section (22) can have a significant effect on the degree of straightness or uniformity of positioning of sealing blade (26) with respect to the surface of the developer roller (80). The conformation of the roller section (22) and hopper section (24) of the process (toner) cartridge required for proper operation is achieved during cartridge reassembly as described below.

Figure 3:
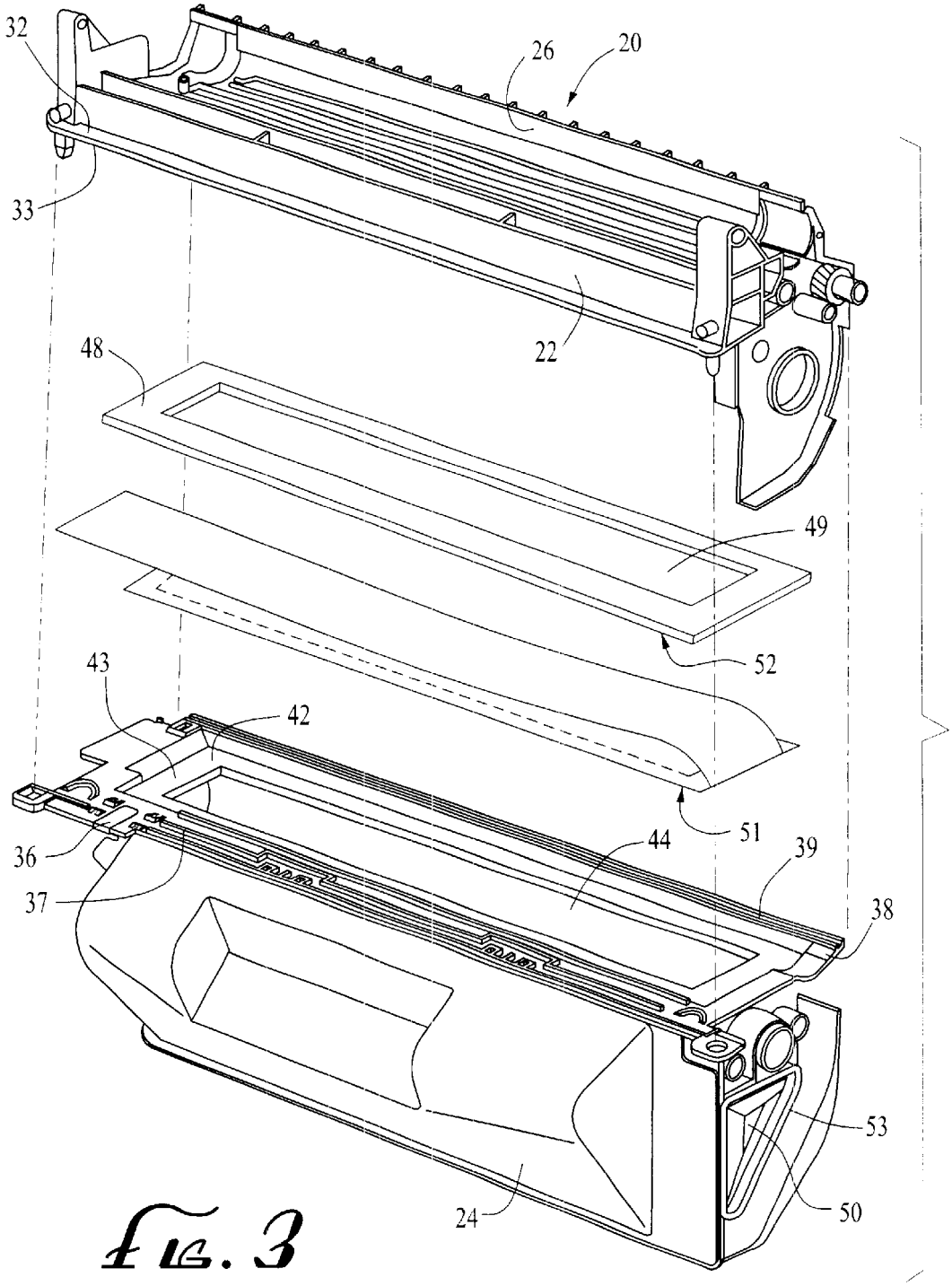
FIG. 3 is a partially disassembled perspective view of a hopper section, hopper section toner port perimeter seal, toner port ribbon seal and roller section assemblies of a process (toner) cartridge of an embodiment of the present invention.

FIG. 3 is a partially disassembled perspective view of a hopper section (24), hopper section toner port perimeter seal (48), toner port ribbon seal (46) and roller section (22) assemblies of a process cartridge (20) of an embodiment the present invention. The toner cartridge (20) includes other components such as a waste hopper, developer roller, and other subassemblies which are not shown in FIGS. 2–8 for clarity. Hopper section (24) includes toner port seal cavity (42) in which is formed toner port (44). Sealing surface (43) of cavity (42) is adapted to accept and mates with adhesive surface (51) of toner port ribbon seal (46) and adhesive surface (52) of toner port perimeter seal (48), to close and seal toner port (44). Toner port ribbon seal (46) and toner port perimeter seal (48) are commercially available as an integral unit from C. F. Technology (Goldseal). Perimeter seal (48) covers a larger area than does ribbon seal (46) and thus maintains a seal against toner leakage upon removal of the ribbon seal by the end user. Also, hopper section (24) includes toner fill port (53) closed by hopper cap (50). FIG. 8 is a partially disassembled perspective view of another embodiment of the present invention in which a toner port perimeter seal (48) is not utilized. Toner port ribbon seal (46) is commercially available as an separate item.

Figure 4:
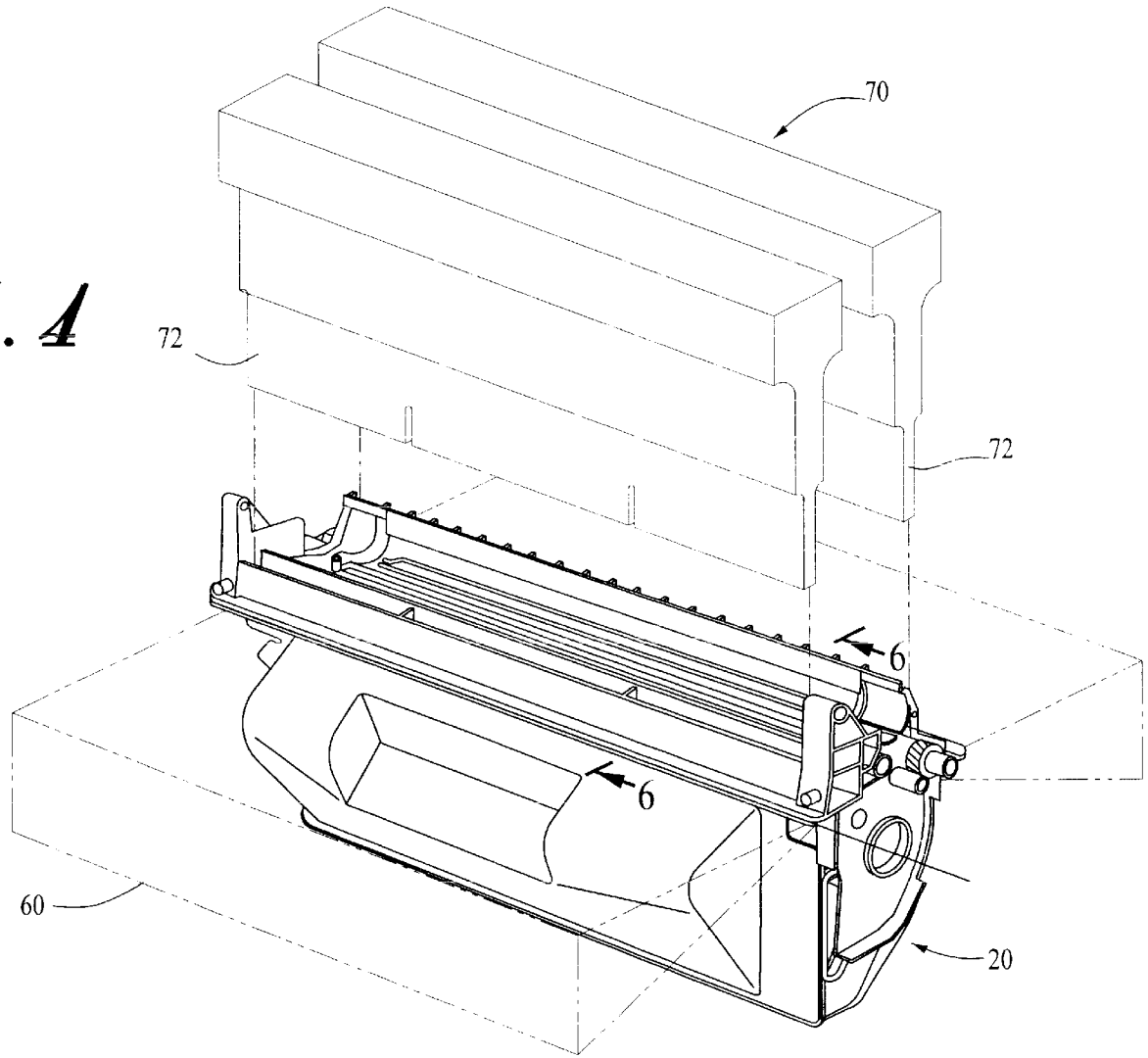
FIG. 4 is a stylized perspective view of an apparatus which may be used in the ultrasonic welding step of an embodiment of the present invention.
Figure 5:
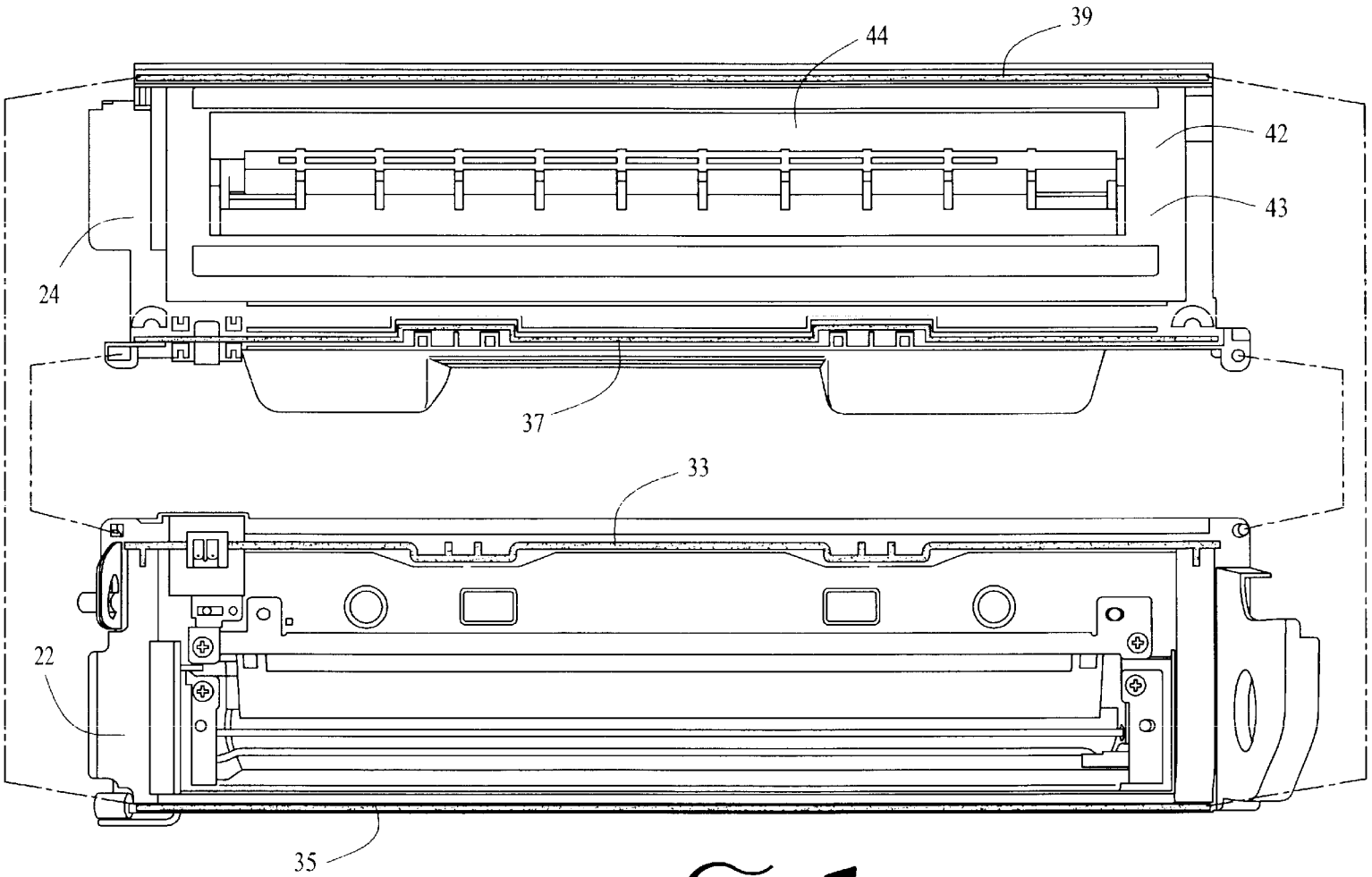
FIG. 5 is a perspective view of a hopper section and a roller section of a representative process cartridge which depicts the mating surface of each section.

With further reference to FIGS. 3, 5 and 8, hopper section (24) includes first peripheral lip (36) having residual energy director element material forming mating surface (37) and second peripheral lip (38) having residual energy director element material forming mating surface (39). Roller section (22) includes first peripheral lip (32) having residual energy director element material forming mating surface (33) and second peripheral lip (34) having residual energy director element material forming mating surface (35). In reassembly of the hopper section (24) together with the roller section (22) mating surfaces (33) and (35) are juxtaposed and interface with mating surfaces (37) and (39), respectively, as is shown in FIGS. 2, 3, 5, 6, 7 and 8. The proper alignment and conformation of cartridge sections (22) and (24) during reassembly to assure of the required degree of straightness and uniformity of positioning of sealing blade (26) with respect to the surface of the developer roller (80) is provided by cartridge clamping jig (60) as is depicted schematically in FIG. 4. Clamping jig (60) is adapted to impose the required alignment and configuration on the cartridge assembly (20) during ultrasonic welding and bond curing.

Now, with reference to FIG. 4, ultrasonic welding of sections (22) and (24) together is accomplished by a dual-head ultrasonic welding horn (72) and ultrasonic welding apparatus (70) such as is available from Branson Ultrasonics Corporation, Danbury, Conn. It is provided that ultrasonic welding (and resealing) of the mating surfaces 33,37 and 35,39 of the cartridge sections take place simultaneously. However, it will be understood by one of ordinary skill in the art that the welding may take place sequentially.

The locations for the ultrasonic welding of sections (22) and (24) is along peripheral lips (32), (34), (36) and (38) at the location of the residual energy director element material which forms mating surfaces (33), (35), (37) and (39) as is depicted schematically in FIGS. 2, 3, 5, 6, 7 and 8. It has been determined that separation of a process cartridge by cleavage, without cutting, along the plane of the original ultrasonic weld often provides a mating surface formed of residual energy director material sufficient alone to initiate and promote rewelding ultrasonically of the refurbished process (toner) cartridge sections during remanufacture. It has been further determined that such rewelding at the site of the residual energy director material forms a weld of the strength required for proper operation of the remanufactured process (toner) cartridge, and reseals the cartridge against toner leakage such that a toner port perimeter seal (48) is not required.

Figures 6, 6A:
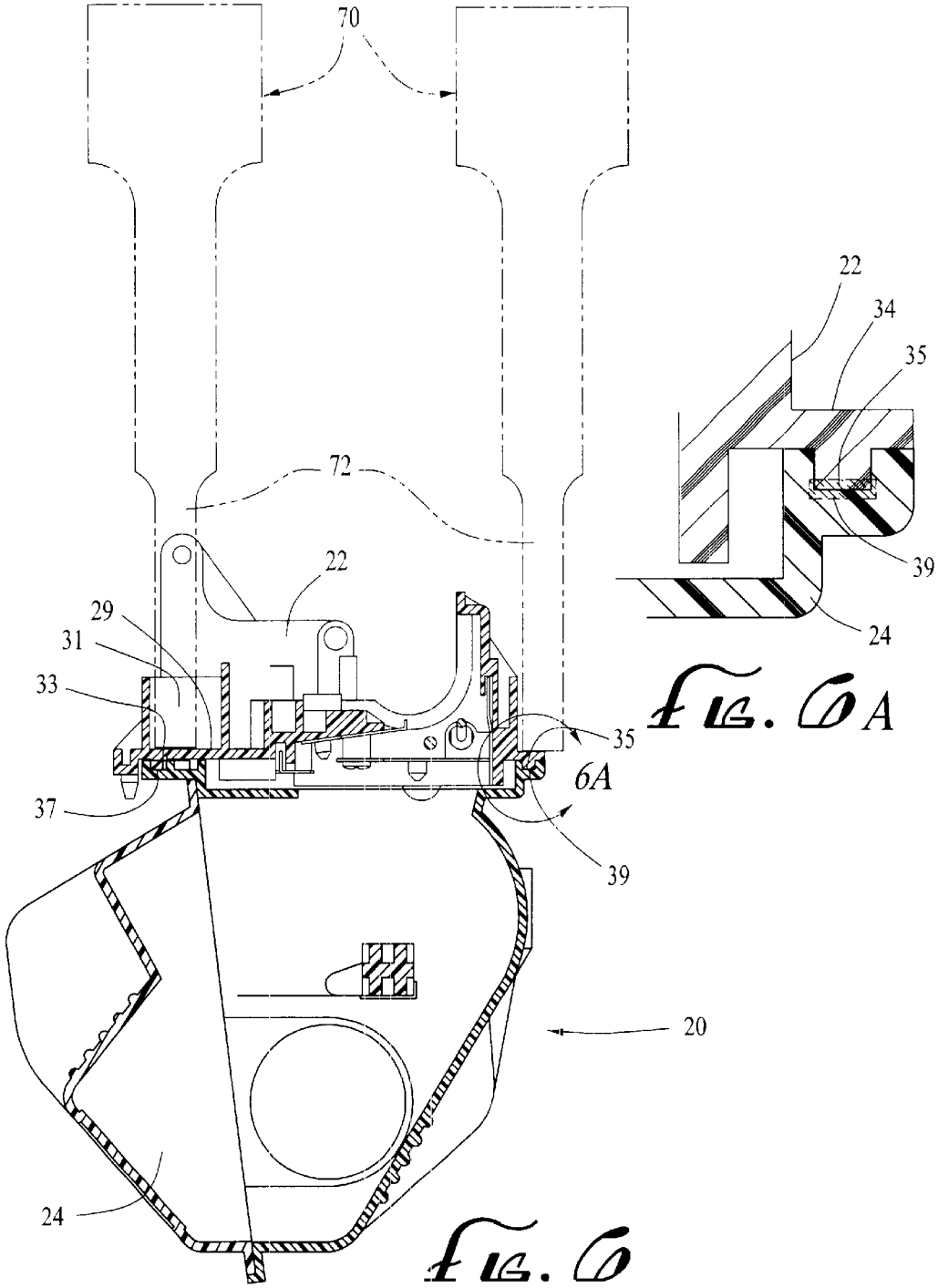
FIG. 6 is a cross-sectional view through a portion of the FIG. 4 assembly of a representative process cartridge of an embodiment of the present invention.
FIG. 6A is a cross-sectional view through a portion of the FIG. 6 assembly of a representative process cartridge of an embodiment of the present invention at the location of an ultrasonic weld stylized to represent conformational change due to melting and pressure from the welding horn in the ultrasonic welding step.

With reference to FIGS. 6 and 6A, an ultrasonic weld (40) is schematically depicted in cross-section to represent conformational change due to melting of the two cartridge sections (22) and (24) and pressure from titanium ultrasonic welding horns (72) which are depicted in partial cross-section. In FIG. 6, welding horns (72) bear on channel floor (29) of longitudinal channel (31) to apply ultrasonic energy to the interface between mating surfaces (33) and (37) of section (22) and section (24), respectively. With further reference to FIGS. 6 and 6A, welding horns (72) bear on second peripheral lip (34) of roller section (22) to apply ultrasonic energy to the interface between mating surfaces (35) and (39) of section (22) and section (24), respectively. The localized melting together of the two interfaced plastic surfaces in proximity to the energized titanium welding horn followed briefly by maintenance of pressure during solidification of the melted material results in formation of a weld.

Figure 7:
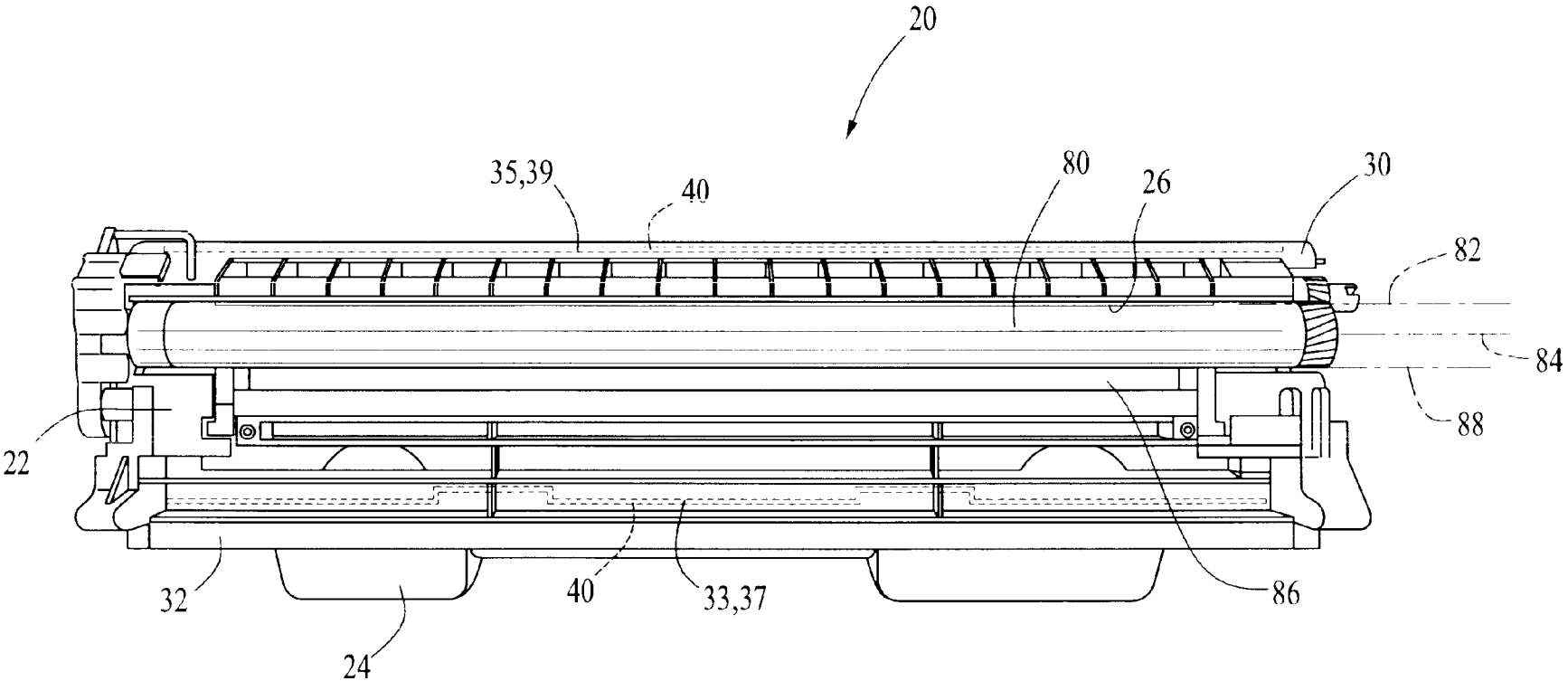
FIG. 7 is a top perspective view of a process (toner) cartridge of the present invention with a developer roller installed.
Figure 8:
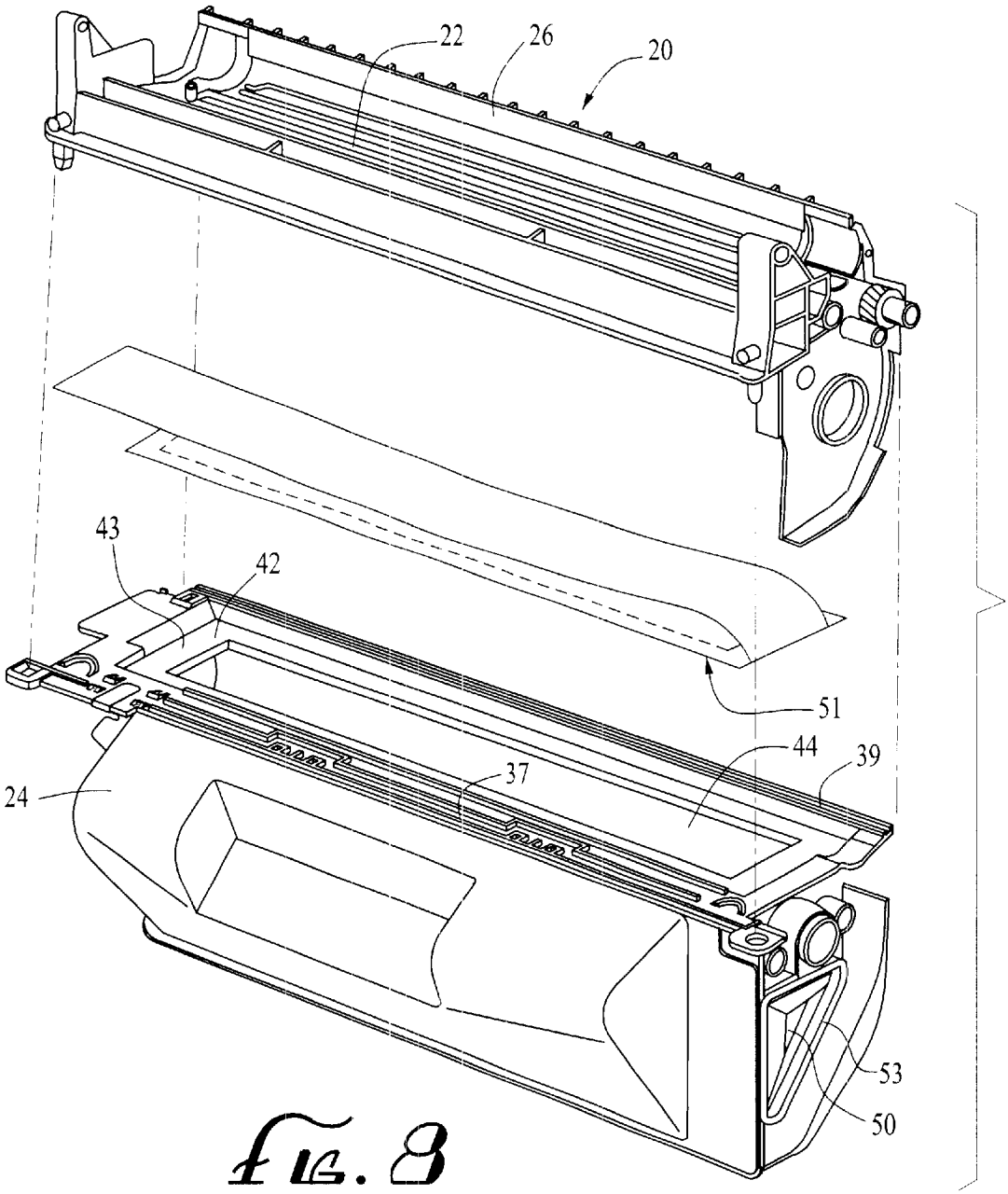
FIG. 8 is a partially disassembled perspective view of a hopper section, toner port ribbon seal and roller section assemblies of a process (toner) cartridge of an embodiment of the present invention.

With reference to FIG. 7, the developer roller (80) is disposed and rotatingly mounted in the roller section (22). Developer roller (80), which is essentially a right circular cylinder in geometry having a longitudinal axis (84), is disposed such that its longitudinal axis (84) extends along the length, or the greatest dimension, of roller section (22). Sealing blade (26) is disposed in roller section (22) such that the greatest dimension, or length, of sealing blade (26) also extends along the length, or the greatest dimension, of roller section (22), as has been previously described. The edge of sealing blade (26) proximate roller (80) defines sealing blade axis (82). Similarly, developing blade (86) is also disposed in roller section (22) such that the greatest dimension of developing blade (86) extends along the length, or the greatest dimension, of roller section (22). The edge of developing blade (86) proximate roller (80) defines developing blade axis (88).

With further reference to FIG. 7, reassembled process (toner) cartridge (20) is maintained in preferred alignment and configuration by ultrasonic welds (40) such that longitudinal axis (84) of developer roller (80) and sealing blade axis (82) are essentially parallel along the extent or length of sealing blade (26), and the proximate surfaces of sealing blade (26) and roller (80) are maintained in substantially constant relation to each other over their mutual extent.

Finally, with yet additional reference to FIG. 7, reassembled process (toner) cartridge (20) is maintained in required alignment and configuration by ultrasonic welds (40) such that longitudinal axis (84) of developer roller (80) and developing blade axis (88) are essentially parallel along the extent or length of developing blade (86), and the proximate surfaces of developing blade (86) and roller (80) are maintained in substantially constant relation to each other over their mutual extent.

THE REASSEMBLY PROCESS

The steps and procedures of an embodiment of the method of remanufacture of the reassembled process or toner cartridge disclosed are described below.

The depleted process or toner cartridge (20) is visually inspected for damage and whether it is suitable to be remanufactured. It is then partially disassembled to remove external components including the waste hopper, gear housing end plates, rollers, and hopper cap, etc. Next, any residual toner is removed and the cartridge is cleaned.

The roller section (22) is then separated from the hopper section (24) by cleaving, without cutting, along the plane of the original ultrasonic weld joining the two sections. Thereafter the components are inspected for cleanliness and integrity, and reused, discarded or recleaned as appropriate. Toner port ribbon seal (46) and toner port perimeter seal (48) (C. F. Technology Goldseal), or alternatively, the toner port ribbon seal (46) alone, is next installed in the hopper section (24), the hopper section then is refilled with appropriate toner, and the hopper cap (50) is installed after which the hopper section is tested for toner leaks.

The roller section (22) is then mated with the recharged hopper section (24) and the loose assembly is placed into a clamp jig which has been constructed to properly align and configure the particular type or model of process cartridge being remanufactured and reassembled. The clamp jig is operated to impose the preferred alignment and configuration on the process cartridge assembly. While the process (toner) cartridge is held in the jig, a multi-head ultrasonic welding horn connected to an ultrasonic welding apparatus simultaneously welds the roller section (22) and the hopper section (24) together along both longitudinal edges at essentially the same locations as the original ultrasonic welds. This welding process requires approximately 1 second. Pressure on the weld points is maintained by the welding apparatus for approximately 10 seconds until the bond has cured, after which the resealed process cartridge (20) is removed from the jig.

Following resealing of the recharged process or toner cartridge, components—new or reconditioned as necessary (developer roller, photoconductive drum, developer blades, etc.)—are installed in the roller section. Finally, the waste hopper is installed and the finished reassembled process (toner) cartridge is subjected to post production quality control testing, after which it is packaged for shipment.

While the present invention has been described in connection with what are present considered to be the most practical and preferred embodiments, it is to be understood that the invention is not to be limited to the disclosed embodiments, but to the contrary, is intended to cover various modifications and equivalent arrangements included within the spirit of the invention, which are set forth in the appended claims, and which scope is to be accorded the broadest interpretation so as to encompass all such modifications and equivalent structures.

What is claimed is:

1. A method of making a reassembled laser printing process cartridge comprising:

disassembling a depleted process cartridge having a roller section joined to a hopper section containing a toner port;

separating said roller section from said hopper section by cleaving, without cutting, through the original ultrasonic weld thereby preserving some residual energy director material;

initiating ultrasonic welding together of the hopper section and the roller section using said residual energy director material; and positioning said ultrasonic weld to be essentially coextensive with the ultrasonic weld of the process cartridge as originally manufactured.

2. The method of making a reassembled process cartridge of claim 1 further including:

installing a toner port ribbon seal prior to said ultrasonic welding step.

3. The method of making a reassembled process cartridge of claim 1 further including:

installing a toner port perimeter seal prior to said ultrasonic welding step.

4. The method of making a reassembled process cartridge of claim 1 wherein:

said roller section includes a sealing blade and a developer roller having substantially parallel long axises; and said roller section is welded in alignment to provide essentially uniform positioning of the sealing blade with respect to the surface of the developer roller along said axises.

5. The method of making a reassembled process cartridge of claim 1 wherein:

said roller section includes a developing blade and a developer roller having substantially parallel long axises; and said roller section is welded in alignment to provide essentially uniform positioning of the developing blade with respect to the surface of the developer roller along said axises.

* * * * *